US007337058B1

(12) United States Patent
Mylaraswamy et al.

(10) Patent No.: US 7,337,058 B1
(45) Date of Patent: Feb. 26, 2008

(54) ENGINE WEAR CHARACTERIZING AND QUANTIFYING METHOD

(75) Inventors: Dinkar Mylaraswamy, Fridley, MN (US); Rida M. Hamza, Maple Grove, MN (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/673,662

(22) Filed: Feb. 12, 2007

(51) Int. Cl.
*G06G 7/70* (2006.01)

(52) U.S. Cl. ..... 701/101

(58) Field of Classification Search ..... 701/101, 701/102, 110, 111, 114, 115; 73/117.3
See application file for complete search history.

(56) References Cited

U.S. PATENT DOCUMENTS

| | | | | |
|---|---|---|---|---|
| 4,674,869 | A | 6/1987 | Pryor et al. | |
| 4,827,417 | A * | 5/1989 | Berger et al. | 701/5 |
| 5,644,394 | A | 7/1997 | Owens | |
| 6,681,728 | B2 * | 1/2004 | Haghgooie et al. | 123/90.11 |
| 6,700,668 | B2 | 3/2004 | Mundy et al. | |
| 6,701,615 | B2 | 3/2004 | Harding et al. | |
| 6,915,236 | B2 | 7/2005 | Tanner et al. | |
| 6,919,956 | B2 | 7/2005 | Kitagawa et al. | |
| 6,992,315 | B2 | 1/2006 | Twerdochlib | |
| 7,047,125 | B1 * | 5/2006 | He et al. | 701/101 |
| 2002/0091459 | A1 | 7/2002 | Meier | |
| 2003/0007861 | A1 | 1/2003 | Brooks et al. | |
| 2005/0232767 | A1 | 10/2005 | Holder | |
| 2006/0090336 | A1 | 5/2006 | Graham et al. | |

* cited by examiner

*Primary Examiner*—Hieu T. Vo
(74) *Attorney, Agent, or Firm*—Ingrassia Fisher & Lorenz

(57) ABSTRACT

A method for characterizing engine wear includes the steps of generating operational data representative of engine operation, comparing the operational data with baseline operational data generated by a baseline operational model of the engine and generating a first deviation vector based on this comparison, generating a plurality of data images of an engine component following engine operation, comparing each of the plurality of data images with a baseline image of the engine component and generating a second deviation vector based on this comparison, and quantifying a relationship between the first deviation vector and the second deviation vector. The first deviation vector represents variation between the operational data and the baseline operational data. The second deviation vector represents variation between the plurality of data images and the baseline images.

20 Claims, 7 Drawing Sheets

102

178

| COMPONENT : FAULT MNEMONIC | SEVERITY LEVEL | MODIFIERS |
|---|---|---|
| TURBINE : MATERIAL LOSS AT THE BLADE TIPS | $L_{MIN}, L_2, \ldots L_{MAX}$ | $(k_{L1}^{F1}, \delta_{L1}^{F1}), \ldots (k_{L1}^{F1}, \delta_{L1}^{F1})$ |
| TURBINE : MATERIAL LOSS SUCH AS TRAILING EDGE | $L_{MIN}, L_2, \ldots L_{MAX}$ | $(k_{L1}^{F1}, \delta_{L1}^{F1}), \ldots (k_{L1}^{F1}, \delta_{L1}^{F1})$ |
| TURBINE : BLADE SHAPE CHANGE DUE TO BENDING OR FOD | $L_{MIN}, L_2, \ldots L_{MAX}$ | $(k_{L1}^{F1}, \delta_{L1}^{F1}), \ldots (k_{L1}^{F1}, \delta_{L1}^{F1})$ |
| COMPRESSOR : MATERIAL LOSS AT THE BLADE TIPS | $L_{MIN}, L_2, \ldots L_{MAX}$ | $(k_{L1}^{F1}, \delta_{L1}^{F1}), \ldots (k_{L1}^{F1}, \delta_{L1}^{F1})$ |
| COMPRESSOR : BLADE SHAPE CHANGE DUE TO BENDING OR FOD | $L_{MIN}, L_2, \ldots L_{MAX}$ | $(k_{L1}^{F1}, \delta_{L1}^{F1}), \ldots (k_{L1}^{F1}, \delta_{L1}^{F1})$ |

195 197 196

*FIG. 5*

ENGINE WEAR CHARACTERIZING AND QUANTIFYING METHOD

FIELD OF THE INVENTION

The present invention generally relates to vehicle engines, and more particularly relates to characterizing engine performance and wear based on operational data and data images of one or more engine components.

BACKGROUND OF THE INVENTION

Various techniques have been attempted for monitoring and characterizing vehicle engine wear. For example, vehicle engines may be routinely examined, maintained, and repaired according to predetermined maintenance schedules, when an operational problem is detected, and/or at various other points in time. It may also be useful to determine various measures of engine wear in between such maintenance schedules, such as during vehicle operation or shortly before or after. However, determining engine wear at such times may be difficult and/or costly, because the engine is installed on the vehicle, rather then sitting in a maintenance facility. It may also be useful to determine various performance characteristics of an engine based on a known measure of engine wear. However, this may also be difficult in certain situations, such as when the engine is disassembled or removed from the vehicle.

Accordingly, there is a need for an improved method for characterizing engine performance and wear, for example to (i) determine a measure of engine wear given known engine performance characteristics, for example between maintenance schedules when the engine is installed on the vehicle and/or otherwise ready for operation; and (ii) determine engine performance characteristics given a known measure of engine wear, for example when the engine is disassembled or removed from the vehicle.

SUMMARY OF THE INVENTION

A method is provided for characterizing engine wear. In one embodiment, and by way of example only, the method comprises the steps of generating operational data representative of engine operation, comparing the operational data with baseline operational data generated by a baseline operational model of the engine and generating a first deviation vector based on this comparison, generating a plurality of data images of an engine component following engine operation, comparing each of the plurality of data images with a baseline image of the engine component and generating a second deviation vector based on this comparison, and quantifying a relationship between the first deviation vector and the second deviation vector. The first deviation vector represents variation between the operational data and the baseline operational data. The second deviation vector represents variation between the plurality of data images and the template (herein referred to baseline) images.

In another embodiment, and by way of example only, the method comprises the steps of generating operational deviation information based on a comparison between operational data representative of engine operation and baseline operational data generated by a baseline operational model of the engine, generating image deviation information based on a comparison between each of a plurality of data images of an engine component and a baseline image of the engine component, and quantifying a relationship between the operational deviation information and the image deviation information. The operational deviation information represents variation between the operational data and the baseline operational data. The image deviation information represents variation between the plurality of data images and the baseline images.

In yet another embodiment, and by way of example only, the method comprises the steps of generating operational data representative of engine operation, comparing the operational data with baseline operational data generated by a baseline operational model of the engine and generating a first deviation vector based on this comparison, generating a plurality of data images of an engine component following engine operation, comparing each of the plurality of data images with a baseline image of the engine components and generating a second deviation vector based on the comparison, quantifying a relationship between the first deviation vector and the second deviation vector, and quantifying a measure of wear for the particular engine, based at least in part on operational data for the particular engine and the quantified relationship between the first deviation vector and the second deviation vector. The first deviation vector represents variation between the operational data and the baseline operational data. The second deviation vector represents variation between the content and the plurality of data images and the baseline images.

BRIEF DESCRIPTION OF THE DRAWINGS

The present invention will hereinafter be described in conjunction with the following drawing figures, wherein like numerals denote like elements.

FIG. 5 is a table showing an exemplary embodiment of a look-up table generated by the process of FIG. 1;

DETAILED DESCRIPTION OF A PREFERRED EMBODIMENT

Before proceeding with the detailed description, it is to be appreciated that the described embodiment is not limited to use in conjunction with a particular type of turbine engine. Thus, although the present embodiment is, for convenience of explanation, depicted and described as being implemented in a multi-spool turbofan gas turbine jet engine, it will be appreciated that it can be implemented in various other types of turbines, and in various other systems and environments.

Figure 1:
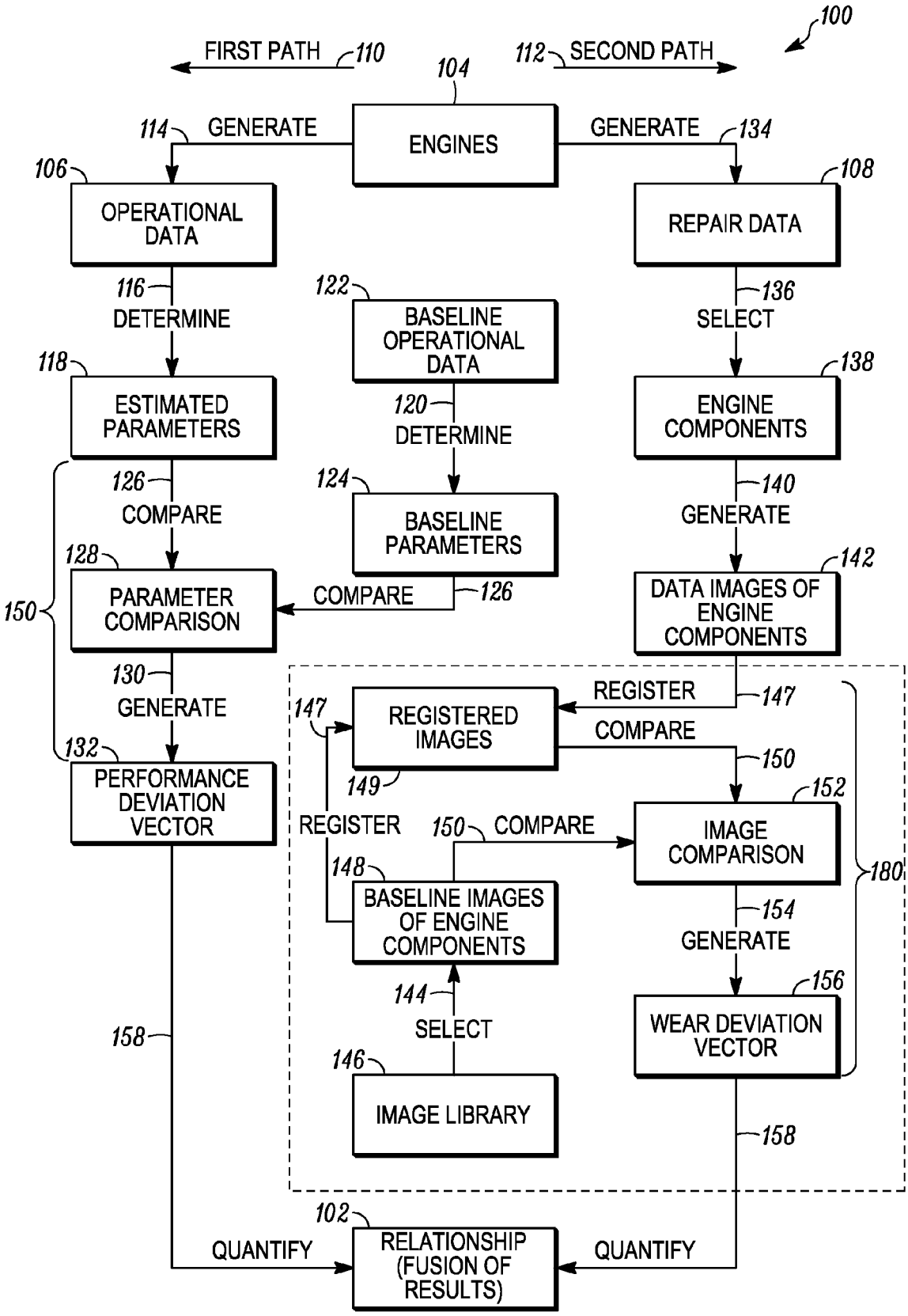
FIG. 1 is a flowchart showing an exemplary embodiment of a characterizing process for quantifying a relationship between engine performance characteristics and engine wear characteristics using operational data and repair data.

FIG. 1 depicts an exemplary embodiment of a characterizing process 100 for quantifying a relationship 102 between performance characteristics and wear of a vehicle engine 104 using operational data 106 and repair data 108. The characterizing process 100 initially proceeds separately along a first path 110, using the operational data 106, and a second path 112, using the repair data 108. The steps of the first and second paths 110, 112 may be conducted simultaneously or in either order, but will be discussed separately below for ease of reference.

The first path 110 begins with step 114, in which the operational data 106 is generated from engines 104 installed in a plurality of vehicles. Preferably, the operational data 106 includes data from a relatively large number of vehicles with engines at different stages of their lifespan and having been operated under a wide range of operating conditions. In step 116, the operational data 106 is utilized to determine various estimated parameters 118 pertaining to performance characteristics of the engines 104. As discussed further below in connection with FIGS. 2 and 3, the estimated parameters 118 preferably include coefficients for one or more equations that use the operational data 106 to map various performance characteristics of the engines 104 as a function of time, as a function of one or more environmental conditions, and/or as a function of one or more other variables.

Meanwhile, in step 120, baseline operational data 122 is used to generate, for comparison purposes, baseline parameters 124 pertaining to the same or similar performance characteristics as the estimated parameters 118, but for prototype engines 104 which are new and have experienced little, if any, wear—for example engines during design testing. The baseline operational data 122 may be obtained from previous studies or testing, vehicle manuals, manufacturer specifications, literature in the field, and/or any number of other different types of sources including data collected during engine design. As will also be discussed further below in connection with FIGS. 2 and 3, the baseline parameters 124 preferably include coefficients for one or more equations that use the baseline operational data 122 to map typical or expected performance characteristics of the engines 104 as a function of time, as a function of one or more environmental conditions, and/or as a function of one or more other variables, under the further assumption that the engines 104 are in new condition, and have experienced little, if any, wear.

The baseline parameters 124 are then compared, in step 126, with the estimated parameters 118, thereby generating a parameter comparison 128. As will be discussed further below in connection with FIGS. 2 and 3, step 126 preferably includes calculating a deviation between the equation coefficients representing the estimated parameters 118 and those representing the baseline parameters 124. This equation coefficient deviation preferably corresponds with a shift in one or more maps. Such a shift corresponds with deviations in actual engine performance (as determined from the operational data 106) as compared with the baseline engine performance (as determined from the baseline operational data 122), and may be attributable to, and correlated with, one or more measures of wear of the engine 104.

Next, in step 130, the parameter comparison 128 is used to generate a performance deviation vector 132. Preferably this is accomplished using one or more clustering and/or other statistical or other mathematical techniques known in the art. As will be described further below, the performance deviation vector 132 is subsequently (following the completion of the steps of the second path 112 described below) used in generating the above-referenced relationship 102 between engine performance characteristics and engine wear. Steps 126 and 130 shall also hereafter be referenced as a combined step 160, as described in greater detail further below in connection with FIGS. 2 and 3.

Turning now to the second path 112, first, in step 136, one or more engine components 138 are selected for examination using the repair data 108. Specifically, the selected engine components 138 represent parts and/or features of the engines 104 that are examined to determine one or more measures of wear. For example, the selected engine components 138 may be examined to detect material loss at turbine blade tips, material loss at a turbine blade turbine edge, turbine blade shape and/or bending, and/or color changes in turbine blades, among various other potential engine wear measures.

Next, in step 140 a plurality of data images 142 are obtained of the engine components 138. The data images 142 may be obtained from photographs taken from various engines 104 at different points in the lifespan of the engines 104, for example when the engines 104 are undergoing maintenance, repair, or inspection. The data images 142 may be taken at different angular perspectives with respect to its mounting into the engine or captured at a special acquisition setting (i.e. special mounting to have consistent image acquisition setting) for referencing. This may represent various templates of the components at different angles used later for comparison. Preferably, the data images 142 are collected for a large number of different engines 104 at various points in the respective lifespans of the engines 104, and reflect a wide variety of different operating conditions. This is done to generate a more robust collection of data images 142. For example, the data images 142 pertaining to a particular type of engine 104 may include images of various engine components 138 in a variety of different types of aircraft or other vehicles, after various stages of operation, and after operation in different geographic, weather, and other environmental conditions.

Meanwhile, in step 144, baseline (i.e. template) images 148 of the selected engine components 138 are selected from an image library 146. Preferably the image library 146 includes various three dimensional computer aided design (CAD) images showing the selected engine components 138 of the various engines 104 at various angles and positions, and under ideal circumstances. For example, while the above-referenced data images 142 depict engine components 138 of various engines 104 at various points in the lifespan of the engines 104, the baseline images 148 depict engine components 138 of one or more prototype engines 104 under design or acceptable conditions, for example when the engines 104 are new and have experienced little, if any, wear.

The data images 142 from the repair data 108 are then registered, in step 147, using the baseline images 148 from the image library 146, to thereby generate registered images 149. These registered images 149 are then compared, in step 150, with the baseline images 148, to thereby generate an image comparison 152. As discussed further below in connection with FIG. 4, the image comparison 152 is preferably generated by registering the data images 142 with the baseline images 148, warping the data images into the template framework for comparison and determining frame differences between the respective images (image comparison may be executed at the raw pixel level or at the feature level); however, this may vary. Next, in step 154, the image comparison 152 is used to generate a wear deviation vector 156, preferably using one or more clustering and/or other statistical or other mathematical techniques known in the art. Steps 144, 147, 150, and 154 shall also hereafter be referenced as a combined step 180, as described in greater detail further below in connection with FIG. 4. As will now be described, the wear deviation vector 156 is then used in generating the above-referenced relationship 102 between engine performance characteristics and wear.

Figure 6:
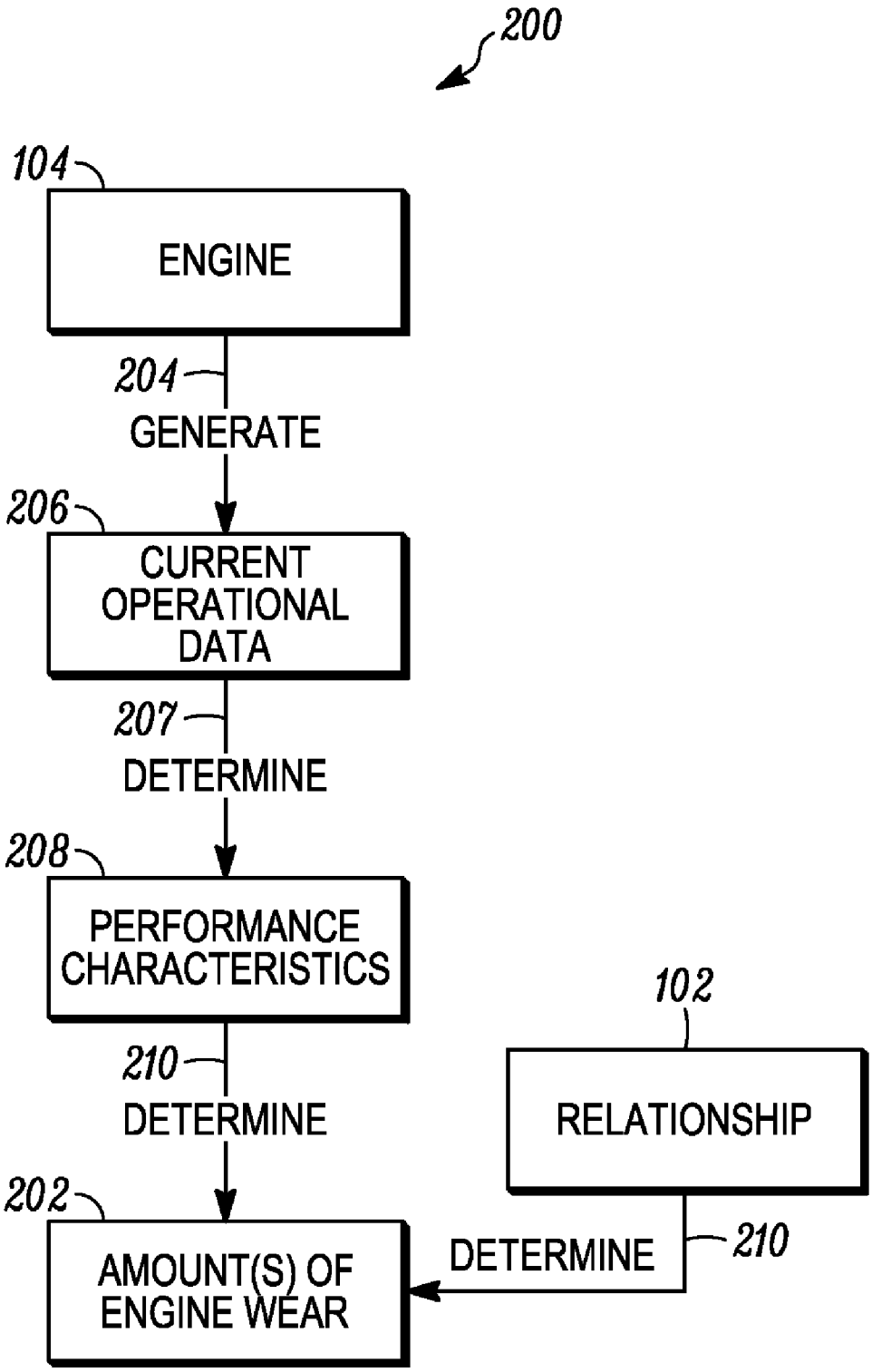
FIG. 6 is a flowchart of an exemplary embodiment of a wear determining process for determining a measure of wear of a vehicle engine based on operational data, that can be conducted using the quantified relationship of the process of FIG. 1.
Figure 7:
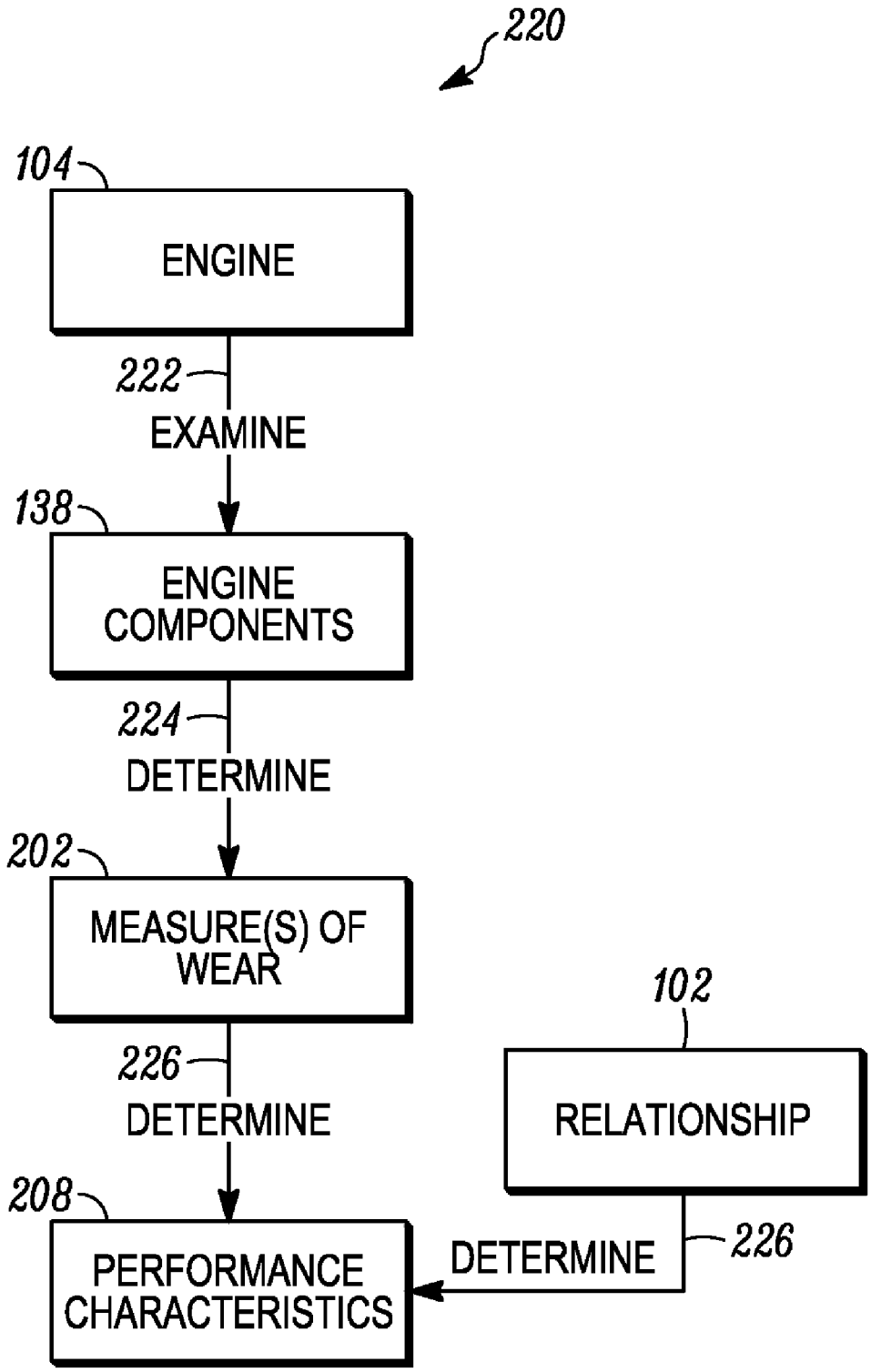
FIG. 7 is a flowchart of an exemplary embodiment of a performance characteristic determining process for determining performance characteristics of a vehicle engine based on a known measure of engine wear, that can be conducted using the quantified relationship of the process of FIG. 1.

Specifically, in step 158, following completion of the first and second paths 110, 112, the relationship 102 is quantified by correlating the performance deviation vector 132 and the wear deviation vector 156. The relationship 102 is preferably quantified using one or more clustering and/or other statistical or other mathematical techniques for data fusion known in the art. The quantified relationship 102 may take the form of an equation, map, look-up table (such as that depicted in FIG. 5 and discussed further below), or various other types of tools representing a correlation between the performance deviation vector 132 and the wear deviation vector 156. The quantified relationship 102 can then be used to (i) determine a measure of engine wear given specific operational data 106 (as depicted in FIG. 6 and described further below in connection therewith) and (ii) determine various engine performance characteristics given a known measure of engine wear (as depicted in FIG. 7 and described further below in connection therewith), along with various other potential applications.

Figure 2:
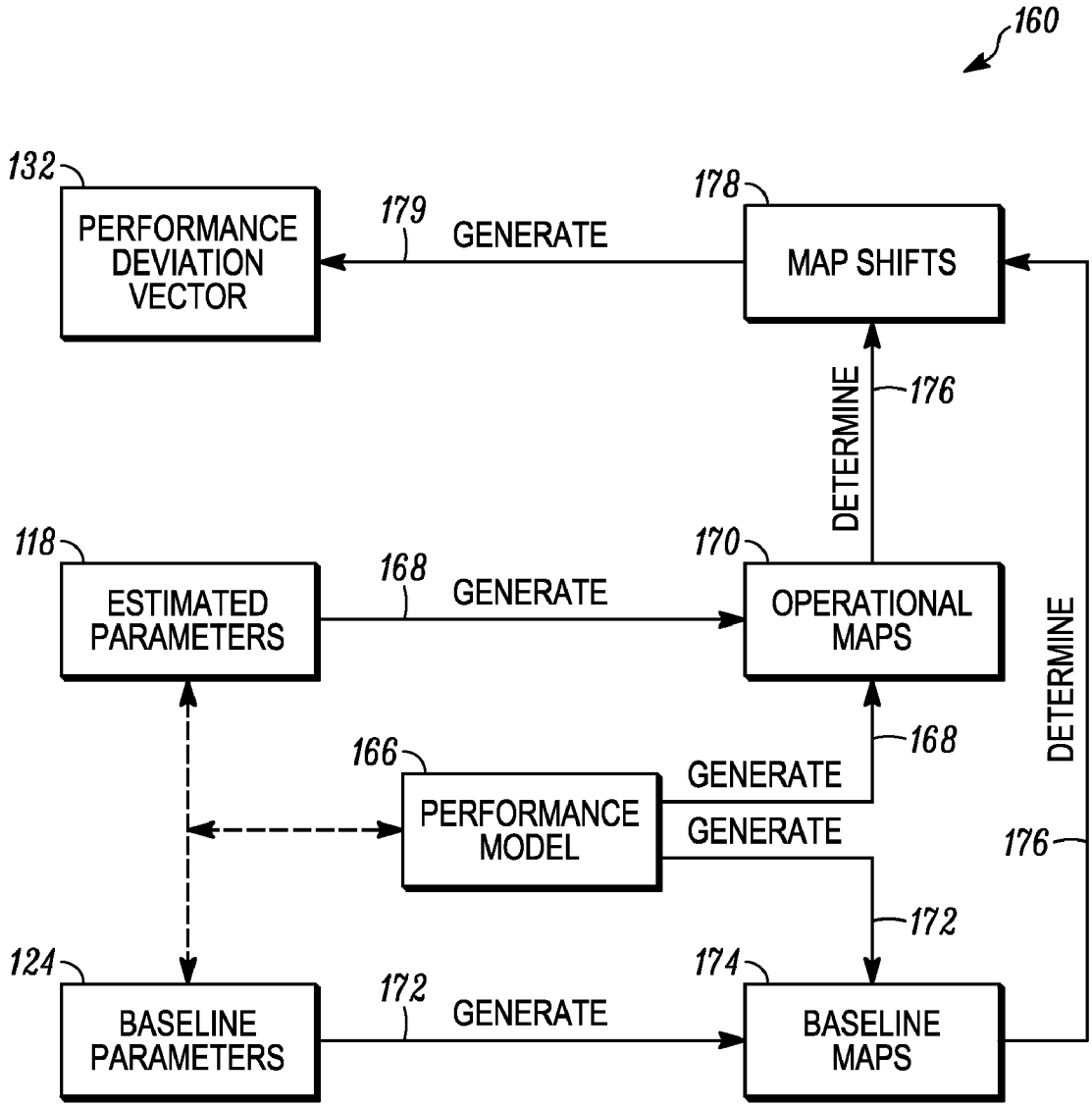
FIG. 2 is a flowchart showing an exemplary embodiment of certain steps of the characterizing process of FIG. 1 pertaining to the generation of a performance deviation vector.

Turning now to FIG. 2, an exemplary embodiment is depicted for the above-referenced combined step 160 of FIG. 1 for comparing the estimated parameters 118 and the baseline parameters 124 and generating the performance deviation vector 132. As shown in FIG. 2, a performance model 166 is utilized in steps 168 and 172 to generate operational maps 170 and baseline maps 174. The performance model 166 preferably is a component level model for the engines 104, and describes thermodynamic relationships between key components of the engines 104.

Specifically, the performance model 166 characterizes the behavior of each of the selected components 138 of the engines 104 as described in a set of algebraic equations with corresponding maps. For example, the performance model 166 includes one or more equations, such as the exemplary equation set forth below:

$$Y=F(X,M) \qquad \text{(Equation 1)},$$

where Y represents various outputs of the performance model 166, X represents various inputs of the performance model 166, and M denotes various maps of the performance model 166. Equation 1 is a simplified representation, and it will be appreciated that any number of different inputs, outputs, maps, and relationships therebetween can be used in the equations for the performance model 166. The inputs and outputs are preferably reflected in the above-referenced estimated parameters 118 and baseline parameters 124 generated in steps 116 and 120, respectively, from the operational data 106 and the baseline operational data 122, respectively.

As show in FIG. 2, in step 168 operational maps 170 are generated from the performance model 166, preferably using Equation 1 and the estimated parameters 118 previously determined in step 116 of FIG. 1. Each operational map 170 includes a graphical representation of a dependent variable including one or more performance characteristics of the engines 104 from which the operational data 106 was generated, plotted as a function of an independent variable including one or more environmental conditions or other measures that may affect engine performance. The operational maps 170 are generated from the operational data 106 using statistical regression techniques such as ordinary least square regression modeling, or any one of a number of different types of statistical techniques.

Meanwhile, in step 172, baseline maps 174 are generated from Equation 1, using the baseline parameters 124 previously determined in step 120 of FIG. 1. Each baseline map 174 includes a graphical representation of a dependent variable including typical or expected values of the performance characteristics reflected in a corresponding operational map 170, but based on data from the baseline operational data 122 for prototype engines 104 that are new and have experienced little, if any, wear. Such a dependent variable is similarly plotted as a function of the independent variable from the corresponding operational map 170. The baseline maps 174 are generated from the baseline operational data 122 using statistical regression techniques such as ordinary least square regression modeling, or any one of a number of different statistical techniques. The baseline maps 174 may be generated prior to the generation of the corresponding operational maps 170, and in some instances prior to the generation of the operational data 106. For example, the baseline maps 174 may be obtained or derived from previous studies or testing, vehicle manuals, manufacturer specifications, literature in the field, and/or any number of other different types of sources.

Each baseline map 174 is then compared to its corresponding operational map 170 in step 176, to determine a corresponding map shift 178 representative of the operational data 106. For example, using the exemplary Equation 1 set forth above, each baseline map 174 and its corresponding operational map 170 can be characterized by an additional equation:

$$M=k*M_o+\delta \qquad \text{(Equation 2)},$$

where $M_0$ represents a baseline map 174, M represents a corresponding operational map 170, and k and δ represent values reflecting a map shift 178. A baseline map 174 for an engine component 138 from the baseline operational data 122 is characterized by values of k equal to one and δ equal to zero. Accordingly, for a corresponding operational map 170, the values of k and δ, and in particular their deviation from one and zero, respectively, represent the map shift 178 between the baseline map 174 and the corresponding operational map 170. Therefore, the map shift 178 represents differences reflected in the operational data 106 as compared with the baseline operational data 122.

Figure 3:
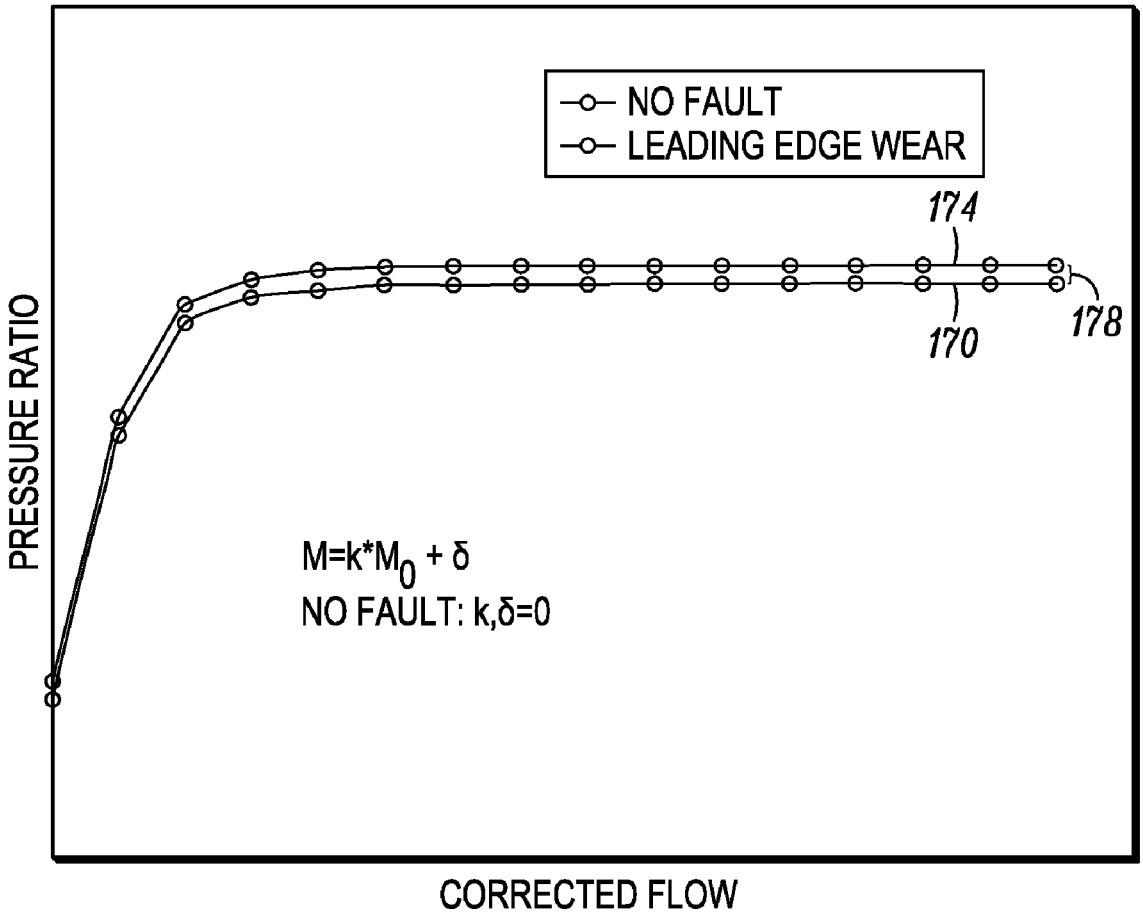
FIG. 3 is an exemplary embodiment of a graph of certain engine performance characteristics that can be used in the characterizing process of FIG. 1 and the steps of FIG. 2.

FIG. 3 depicts an example of a baseline map 174, along with a corresponding operational map 170 and its corresponding map shift 178. By way of example only, the depicted baseline map 174 and corresponding operational map 170 are graphical representations of an engine pressure ratio as a function of corrected engine flow at ninety two percent speed. The map shift 178 represents the deviation from the baseline map 174 to the corresponding operational map 170, for values of k and 6 deviating from their respective values of one and zero, respectively, in the baseline map 174.

While FIG. 3 depicts only a single set of one baseline map 174 and a corresponding operational map 170 and map shift 178 corresponding to a particular combination of variables (namely, engine pressure ratio versus corrected engine flow)

under a particular operating condition (namely, ninety percent speed), it will be appreciated that any number of different sets of baseline maps 174 and corresponding operational maps 170 and map shifts 178 may also be used. For illustrative purposes only, in the example of FIG. 3 various non-depicted additional sets of baseline maps 174 and corresponding operational maps 170 and map shifts 178 may be used for mapping engine pressure ratio versus engine corrected flow at any number of different speed percentage values and/or under various other operating conditions. In addition, any number of different additional sets of baseline maps 174 and corresponding operational maps 170 and map shifts 178 may also be used for any number of other different independent variable and dependent variable combinations, under any number of different operating conditions.

Preferably, for each engine 104 of a particular type from which the operational data 106 was generated, a separate map shift 178 is generated, using a common baseline map 174 and different operational maps 170 for each engine 104 belonging to this engine type. Collectively, the map shifts 178 preferably include a series of (k,δ) values calculated using operational data 106 captured from engines 104 exhibiting a wide variety of engine wear, operated under a wide variety of operating conditions and environments, and/or tested during various stages of engine lifespans. Additionally, this process can then be repeated for engines 104 belonging to different engine types, using a different performance model 166 for each such engine type.

Next, and returning now to FIG. 2, in step 179 the performance deviation vector 132 is generated using the map shifts 178 generated in step 176, preferably using one or more clustering and/or other statistical or other mathematical techniques known in the art. This post-processing step 179 minimizes noise introduced by the data acquisition system that is used to collect operational data 106 from an installed engine 104. Hence, the performance deviation vector 132 is more characteristic of the underlying wear and effects of sensor and data acquisition noise is minimized. As described further below, the performance deviation vector 132 is subsequently used in generating the above-referenced relationship 102 between engine 104 performance characteristics and wear, following the completion of the second path 112.

Figure 4:
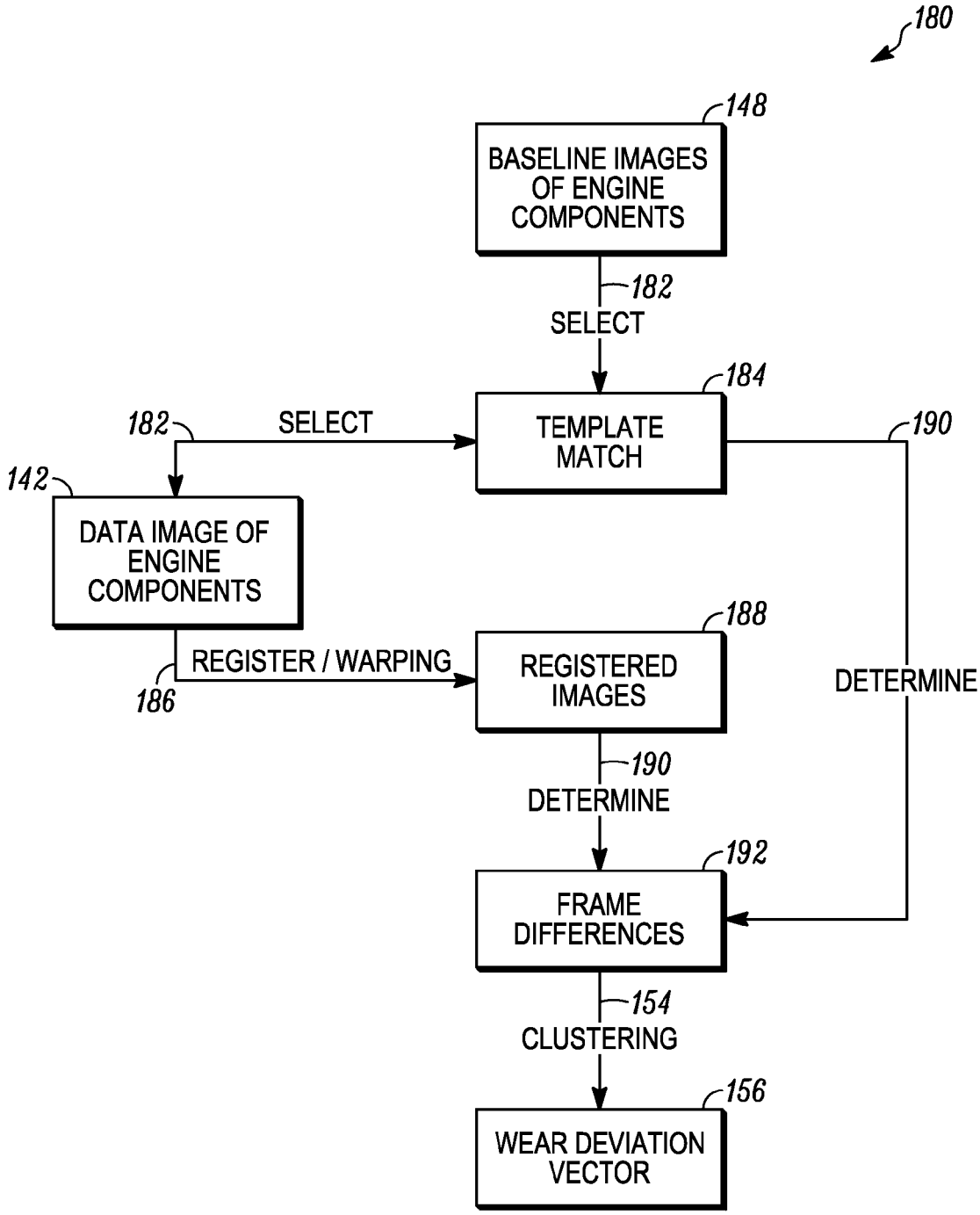
FIG. 4 is a flowchart showing an exemplary embodiment of certain additional steps of the characterizing process of FIG. 1 pertaining to the generation of a wear deviation vector.

Turning now to FIG. 4, an exemplary embodiment is depicted for the combined step 180 of FIG. 1 for the comparison of the data images 142 with the baseline images 148 and the generation of the wear deviation vector 156. As shown in FIG. 4, first, in step 182, a template match 184 is selected, from the baseline images 148, as a best fit for each corresponding data image 142 preferably based upon the imaging perspective. The template match 184 is preferably a three dimensional CAD model that is selected based on the type of engine 104 depicted in the corresponding data image 142 and the view of the engine components 138 depicted therein, along with any number of criteria such as the zoom angle, the projection angle, the placement of a turbine blade against an appropriate background, and/or the shape of the turbine hub, among various other potential criteria. In another embodiment, the baseline images are based on two dimensional images acquired at a special acquisition setting to maintain the same referencing of imaging. The same acquisition setting is then used to acquire images of the engine components. Using such criteria, the template match 184 is preferably selected in step 182 from a plurality of potential matching templates, using SIFT (scale invariant feature tech) techniques and/or other statistical and/or mathematical techniques.

Next, in step 186, each template match 184 is registered with its corresponding data image 142, thereby generating a pair of registered images 188. Preferably, in step 186, such image registration includes spatial masking, wherein one or more portions of the data image 142 is ignored, so that the data image 142 and the template match 184 can be aligned with respect to one or more other, non-ignored portions. For example, if the engine component 138 under examination at a particular point in time includes a turbine blade, then in step 186 a template match 184 and its corresponding data image 142 may first be registered at least in part by initially ignoring the turbine blades depicted in the respective images and aligning the images by initially focusing on other features, such as the turbine hub and disk, to register the images for subsequent comparison of the turbine blades depicted therein. Additionally, the registration process of step 186 may also include warping one or both of the images to account for potential camera resolution differences and misalignments, particularly in cases in which the template match 184 is not generated by the same camera or other device that was used to generate the corresponding data image 142. It will be appreciated that the registration process may vary in accordance with any one or more of a number of different image registration processes known in the art.

Next, in step 190, various frame differences 192 are determined from the pair of registered images 188, using or more frame differencing techniques. The differencing techniques may be executed at the pixel or feature level. The frame differences 192 are preferably calculated only at the region of interest that comprises the engine components 138 under examination. For example, in the above-described case in which turbine blades in the respective images are to be examined, following the above-described registration process, the turbine blades depicted in the respective registered images 188 are examined with respect to pixel count and/or other characteristics at specific, predefined locations. For example, the pixel count in the respective images can be compared at specific locations by measuring the length of the leading edge, the length of the trailing edge, and/or the height of the turbine blades, to quantify any discrepancy in pixel difference or contrast due to local shading because of change of structure and thereby estimate material loss at these locations. It will be appreciated that the specific engine components 138 under examination, and/or the specific locations pertaining thereto, may vary. Often, the engine manufacturer may recommend such specific or critical locations, and hence providing a list of "variable names" for describing the wear deviation vector 156.

Regardless of the particular engine components 138 and locations selected, the calculated pixel differences are then captured and used in step 154 to generate the above-mentioned wear deviation vector 156, preferably using one or more clustering and/or other statistical or other mathematical techniques. Clustering and/or statistical techniques help in minimizing the noise introduced by the image acquisition system as well as the image differencing step 190. In this step, salient features of pixel difference at previously defined locations like leading edge, trailing edge are clustered into separable categories. These categories are then presented to an engine expert who annotates each of these categories with appropriate measures of wear degradation. In a simple embodiment, measures of way may include two levels-low and high, and/or they may include specific numerical measures such as ten percent (10%) or fifteen percent (15%). As described above in connection with FIG. 1, the wear deviation vector 156 can then be correlated with the performance deviation vector 132 to quantify the relationship 102 between engine performance characteristics and engine wear.

Turning now to FIG. 5, an exemplary embodiment of a quantified relationship 102 is depicted. The relationship 102 depicted in FIG. 5 is in the form of a look-up table correlating various measures of engine wear with various performance characteristics of the engines 104. Specifically, the look-up table 102 includes a first column 195 and a second column 197. The first column 195 includes various values representing measures of various engine wear variables 196, and the second column 197 includes values representing corresponding map shifts 178. The look-up table 102 depicted in FIG. 5 includes engine wear variables 196 such as material loss at turbine blade tips, material loss at turbine blade trailing edges, turbine blade shape (reflecting any bending of the turbine blade), material loss at compressor blade tips, and compressor blade shape (reflecting any bending of the compressor blade). However, it will be appreciated that some or all of the depicted engine wear variables 196 may not be used, and/or that any number of other engine wear variables 196 may instead be used, in various embodiments. Based on certain known measurements pertaining to one or more of the engine wear variables 196 in the first column 195, one can use the look-up table 102 to determine corresponding values representing corresponding map shifts 178, and vice versa, as set forth in greater detail with reference to FIGS. 6 and 7 below. In addition, as mentioned above, the relationship 102 can take various other forms.

Turning now to FIG. 6, an exemplary embodiment of a wear determining process 200 is depicted for determining a measure of wear 202 of one or more engine components 138 of a particular engine 104, based on operational data for the particular engine 104, and using the quantified relationship 102 generated from the characterizing process 100 of FIG. 1. First, in step 204, current operational data 206 is generated for this particular engine 104. The current operational data 206 is used, in step 207, to determine various performance characteristics 208 of the particular engine 104. Next, in step 210, the measure of wear 202 is determined, based upon the performance characteristics 208 and the quantified relationship 102, such as the look-up table 102 depicted in FIG. 5, and/or any one of a number of different embodiments of the quantified relationship 102.

Conversely, FIG. 7 depicts an exemplary embodiment of a performance characteristic determining process 220 for determining one or more performance characteristics 208 of a particular engine 104 based on a known measure of wear 202 for the particular engine 104. The measures of wear 202 preferably pertain to one or more of the selected engine components 138 from FIG. 1. Specifically, the engine components 138 are examined in step 222 to determine, in step 224, one or more measures of wear 202 pertaining thereto. Next, in step 226, various performance characteristics 208 are determined from the measures of wear 202, using the relationship 102, such as the look-up table 102 depicted in FIG. 5, and/or any one of a number of different embodiments of the quantified relationship 102.

The above-described processes allows for improved characterizing and modeling of engine wear and performance characteristics using operational data 106 and data images 142. Such characterizing and modeling can be conducted utilizing data and images collected when the engines 104 are periodically maintained, repaired, or replaced under a variety of circumstances, thereby allowing for a robust data set while also potentially minimizing costs and inconvenience associated with collecting such data. The quantified relationships can then be used to determine estimated performance characteristics based on known engine wear amounts, or vice versa, at various points in time where such analysis may be otherwise be difficult (e.g. determining engine wear when the engine is in operation, or determining performance characteristics when the engine is undergoing maintenance). The above-described processes can also be used in a number of other implementations, for example in determining whether to inspect, replace or repair certain engine parts, or in otherwise monitoring the engines or various measures of wear or performance characteristics pertaining thereto.

It will be appreciated that the methods described above can be used in connection with any one of numerous different types of engines 104, systems, other devices, and combinations thereof, and in characterizing or modeling any number of different types of measures of wear and performance characteristics pertaining thereto. It will also be appreciated that various steps of the above-described processes can be conducted simultaneously or in a different order than described above or depicted in the above-mentioned Figures.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the system particular embodiment disclosed as the best mode contemplated for carrying out this invention, but that the invention will include all embodiments falling within the scope of the appended claims.

What is claimed is:

1. A method for characterizing engine wear, the method comprising the steps of:

generating operational data representative of engine operation;

comparing the operational data with baseline operational data generated by a baseline operational model of the engine, and generating a first deviation vector based on the comparison, the first deviation vector representing variation between the operational data and the baseline operational data;

generating a plurality of data images of an engine component following engine operation;

comparing each of the plurality of data images with a baseline image of the engine component, and generating a second deviation vector based on the comparison, the second deviation vector representing variation between the plurality of data images and the baseline images; and quantifying a relationship between the first deviation vector and the second deviation vector.

2. The method of claim 1, further comprising the step of:

quantifying a measure of wear for a particular engine, based at least in part on operational data for the particular engine and the quantified relationship between the first deviation vector and the second deviation vector.

3. The method of claim 1, further comprising the step of:

quantifying a value of performance for operation of a particular engine, based at least in part on a quantified measure of wear for the particular engine and the quantified relationship between the first deviation vector and the second deviation vector.

4. The method of claim 1, wherein the first deviation vector is generated at least in part using a least squares linear estimation technique.

5. The method of claim 1, wherein the relationship is quantified using a mathematical clustering technique.

6. The method of claim 1, wherein the relationship is quantified using a statistical regression technique.

7. The method of claim 1, wherein the quantified relationship comprises an equation characterizing the first deviation vector as a function of the second deviation vector.

8. The method of claim 1, wherein the quantified relationship comprises an equation characterizing the second deviation vector as a function of the first deviation vector.

9. The method of claim 1, wherein the quantified relationship comprises a table correlating the first deviation vector and the second deviation vector.

10. A method for characterizing engine wear, the method comprising the steps of:

generating operational deviation information based on a comparison between operational data representative of engine operation and baseline operational data generated by a baseline operational model of the engine, the operational deviation information representing variation between the operational data and the baseline operational data;

generating image deviation information based on a comparison between each of a plurality of data images of an engine component and a baseline image of the engine component, the image deviation information representing variation between the plurality of data images and the baseline images; and quantifying a relationship between the operational deviation information and the image deviation information.

11. The method of claim 10, further comprising the step of:

quantifying a measure of wear for a particular engine, based at least in part on operational data for the particular engine and the quantified relationship between the operational deviation information and the image deviation information.

12. The method of claim 10, further comprising the step of:

quantifying a value of performance for operation of a particular engine, based at least in part on a quantified measure of wear for the particular engine and the quantified relationship between the operational deviation information and the image deviation information.

13. The method of claim 10, wherein the relationship is quantified using a mathematical clustering technique.

14. The method of claim 10, wherein the relationship is quantified using a statistical regression technique.

15. The method of claim 10, wherein the quantified relationship comprises an equation characterizing the operational deviation information as a function of the image deviation information.

16. The method of claim 10, wherein the quantified relationship comprises an equation characterizing the image deviation information as a function of the operational deviation information.

17. The method of claim 10, wherein the quantified relationship comprises a table correlating the operational deviation information and the image deviation information.

18. A method for determining a quantifiable measure of wear for a particular engine, the method comprising the steps of:

generating operational data representative of engine operation;

comparing the operational data with baseline operational data generated by a baseline operational model of the engine, and generating a first deviation vector based on the comparison, the first deviation vector representing variation between the operational data and the baseline operational data;

generating a plurality of data images of an engine component following engine operation;

comparing each of the plurality of data images with a baseline image of the engine component, and generating a second deviation vector based on the comparison, the second deviation vector representing variation between the plurality of data images and the baseline images;

quantifying a relationship between the first deviation vector and the second deviation vector; and quantifying a measure of wear for the particular engine, based at least in part on operational data for the particular engine and the quantified relationship between the first deviation vector and the second deviation vector.

19. The method of claim 18, wherein the quantified relationship comprises a table correlating the first deviation vector and the second deviation vector.

20. The method of claim 18, wherein the relationship is quantified using a mathematical clustering technique or statistical regression technique.

* * * * *